United States Patent [19]

Corkigian

[11] Patent Number: 4,794,982

[45] Date of Patent: Jan. 3, 1989

[54] HEAT TRANSFER ENCLOSURE

[75] Inventor: Archibald Corkigian, Hamilton, Canada

[73] Assignee: Westinghouse Canada Inc., Hamilton, Canada

[21] Appl. No.: 138,707

[22] Filed: Dec. 28, 1987

[30] Foreign Application Priority Data

Jul. 9, 1987 [CA] Canada ..... 541741

[51] Int. Cl.[4] ..... H01F 27/08; F28F 19/00

[52] U.S. Cl. ..... 165/104.33; 165/134.1; 165/905; 165/45; 336/58

[58] Field of Search ..... 165/104.33, 134.1, 905, 165/45; 336/55, 58

[56] References Cited

U.S. PATENT DOCUMENTS 1,808,617 6/1931 Thompson ..... 165/104.33
3,168,777 2/1965 DeRidder et al. ..... 165/104.33

FOREIGN PATENT DOCUMENTS 95307 7/1980 Japan ..... 336/58

*Primary Examiner*—Albert W. Davis, Jr.
*Attorney, Agent, or Firm*—Edward H. Oldham

[57] ABSTRACT

A cast iron or steel heat transfer member is used in network protectors to provide optimum cooling while avoiding prior corrosion problems.

4 Claims, 2 Drawing Sheets

HEAT TRANSFER ENCLOSURE

Some electrical apparatus must be enclosed in tanks which are sealed to prevent the ingress of water in order to assure that the enclosed electrical apparatus continues to operate even if the tank is submerged or partially submerged in water. Because of these constraints, it is essential that such apparatus dissipate any heat developed therein through the tank walls by conduction and radiation, there being no possibility of cooling the interior by means of convection.

If the electrical apparatus must be located in underground vaults where occasional flooding is a problem, the environment will probably be moist, and with the heat generated by the contained electrical apparatus within the tank it will be apparent that galvanic corrosion of the apparatus is one of the problems which must be faced.

The above problems have been faced by designers of electrical network protectors in the past and, for the most part, it is possible to coat the apparatus with a protective coating which would permit the dissipation of heat and still protect the exterior surface from corrosion.

Because of the space limitations generally present in underground vaults, designers have been forced to keep the size of such apparatus to a minimum, but the heat generating capability of the contained electrical apparatus continued to remain rather constant. As a result, some method had to be found to improve the heat dissipation of the apparatus which is packed in enclosures having less and less surface area. As a result, the heat dissipation was improved by adding a plurality of "U" shaped strips or fins to the interior and exterior surfaces of the electrical apparatus to present a good heat transfer surface which now is covered with vertically extending fins. The fins were generally attached to the tank surface (inside and out) by spot welding. The resulting structure has been found very satisfactory for the dissipation of the internal heat generated in such apparatus as electrical network protectors, but has increased the corrosion problem significantly. Corrosion occurs on the exterior surface at the interface of the "U" shaped heat dissipation fins and the tank wall to the point where the integrity of the metal tank wall fails in the vicinity of the spot welding heat fins. Several solutions have been attempted to improve the corrosion problem, but most are either very expensive or ineffective from a corrosion or heat transfer point of view.

I have found a solution to the above problem which improves the heat transfer of the tank wall while at the same time eliminates the troublesome corrosion problem. My solution is to weld a cast finned heat transfer device into an aperture provided in the tank wall for receiving such a device. The heat transfer casting will be made from a material of the same region in the electrochemical series so that the galvanic corrosion problem will be minimized. At the same time because of the inherent characteristics of the cast assembly the heat transfer characteristic is improved because of the avoidance of two additional interfaces. This the area required in the tank wall for the heat dissipation casting is roughly one third the area required for the attached "U" shaped fin heat transfer devices.

The drawings attached hereto give a more complete understanding of this invention in which.

Figure 1:
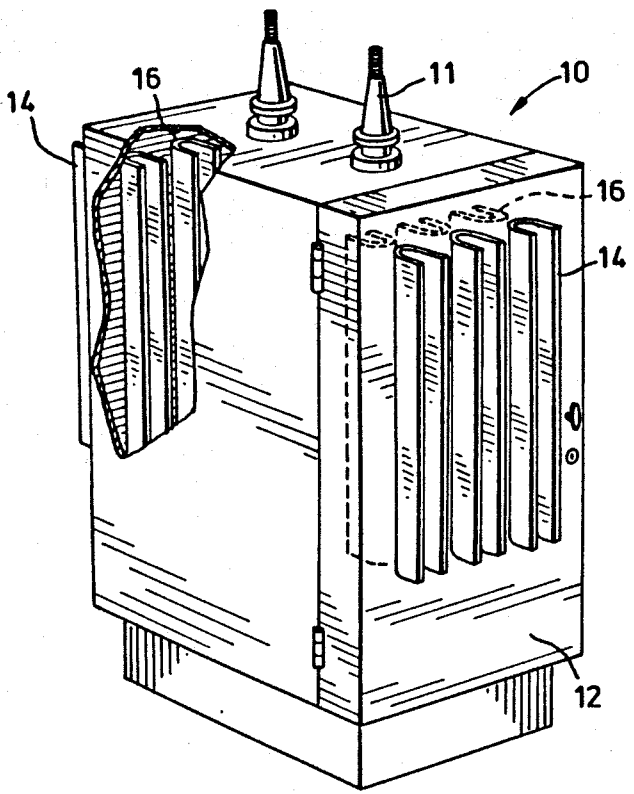
FIG. 1 (PRIOR ART)
FIG. 1 is an illustration of a prior art heat transfer device.

Referring now to FIG. 1, it will be seen that a housing or tank is shown as 10. Tank 10 may house electrical equipment which during its operational life generates heat which must be dissipated by the tank 10 to the surrounding medium. Power is usually fed into and out of the network protector through bushings 11.

Tank 10 may have a gasketed door 12 which sealingly closes the interior of the tank 10. In the past, both the door and tank body have been fabricated from sheets of mild steel. In order to increase the heat transmissibility of the tank structure, a series of "U" shaped heat transfer fins 14 were attached to the exterior surface of the tank 10 by spot welding or other suitable means and a second series of "U" shaped fins 16 were attached to the interior surface of tank 10 immediately opposite the external fins 14. The heat transmissibility of the tank wall increased significantly, but because of the moist environment in which this equipment generally finds itself, galvanic corrosion occurs at the junction of the exterior of the tank and the "U" shaped heat fins, such that in the most adverse operating conditions the tank wall in the vicinity of the coding fins will have corroded to such an extent that the integrity of the tank has been lost in a relatively short period of time.

Figure 2:
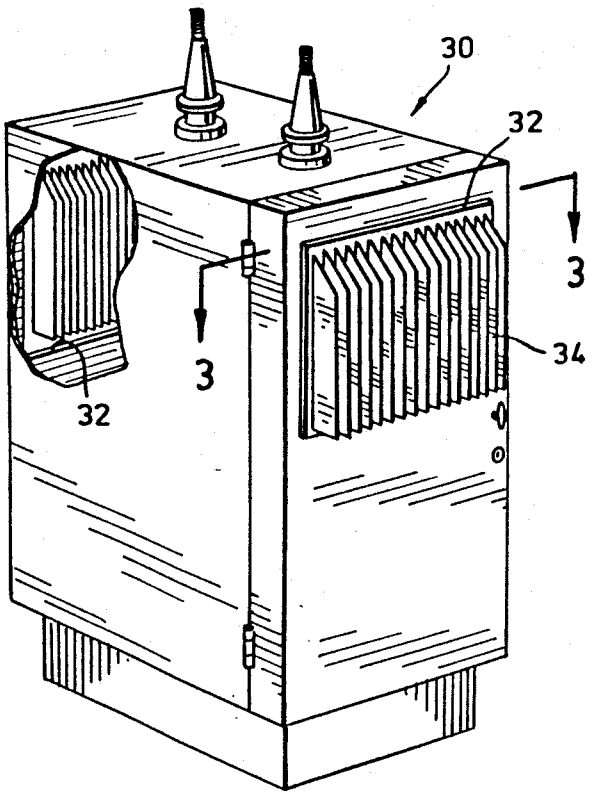
FIG. 2 is an illustration of the cast heat transfer device of this invention installed in a tank wall of a piece of equipment.

To overcome this problem reference may be made to FIG. 2 which shows a fabricated tank 30 being provided with an aperture 32 in the tank wall, the aperture being rectangular in nature. A cast metal grid assembly 34 is welded into the aperture 32 so as to form a waterproof seal at the periphery thereof. The casting and the material forming the tank wall are chosen to be as electrically compatible as possible, for instance if tank 30 is fabricated from mild steel, member 34 will be cast steel, and should the tank be fabricated of stainless steel, the member 34 will be cast stainless steel. In this way the possible occurrence of galvanic corrosion at the weld joint is minimized.

Figure 3:
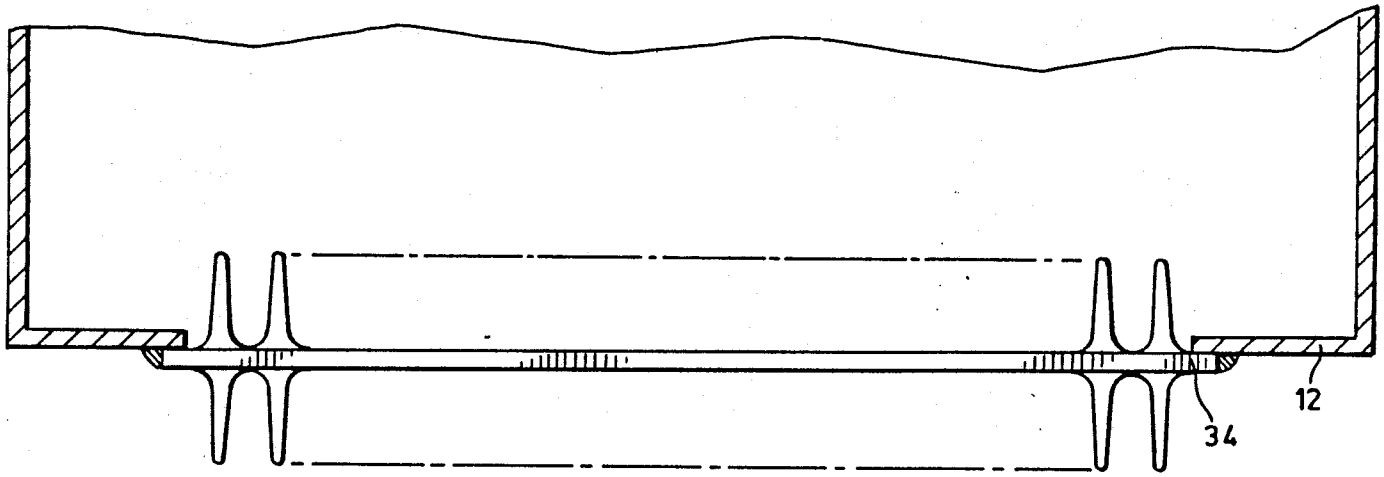
FIG. 3 shows an enlarged sectional view taken along lines 3—3 of FIG. 2.

FIG. 3 shows the casting 34 mounted in aperture 32 in an enlarged view.

Because the two finned surfaces are part of an integral assembly, the heat transmissibility of the member 34 is significantly increased, thus the area required to cool the interior of tank 30 is significantly decreased. Corrosion problems are virtually nonexistent.

I claim:

1. An enclosure for housing electrical apparatus comprising a ferrous metal housing which is capable of operation in a damp corrosive atmosphere, said electrical apparatus being capable of generating heat, said enclosure being sealed to prevent the ingress of water to the interior thereof, heat dissipation means comprising an air to air heat exchanger being located in at least one of the sidewalls of said enclosure, said heat exchanger having a series of raised fins on opposing surfaces thereof to enhance the heat exchange capability thereof, said heat exchanger being formed from a cast ferrous material which is resistive to corrosion.

2. An enclosure for electrical apparatus which is capable of operation in damp corrosive environments comprising:

a ferrous metal housing which is sealed to prevent the ingress of moisture and other contaminants therein from the outside, electrical apparatus contained in said enclosure which during normal operation generates heat, at least one air to air heat exchanger sealedly mounted in the sidewalls of said enclosure to conduct heat from the air inside the enclosure to the air outside, said heat exchanger being cast from a cast ferrous material which is resistive to corrosive attack; said heat exchanger having vertically extending fins on opposite sides thereof to maximize the heat transfer thereof.

3. An enclosure as claimed in claim 1 or claim 2 wherein the enclosure is fabricated from mild steel and said heat exchanger is cast steel.

4. An enclosure as claimed in claim 1 or claim 2 wherein the enclosure is fabricated from stainless steel and the heat exchanger is cast stainless steel.

* * * * *